US009717348B2

(12) United States Patent
Gosling et al.

(10) Patent No.: US 9,717,348 B2
(45) Date of Patent: Aug. 1, 2017

(54) PASS THROUGH SHELF WALL ASSEMBLY

(71) Applicant: DIRTT ENVIRONMENTAL SOLUTIONS INC., Salt Lake City, UT (US)

(72) Inventors: Geoff Gosling, Calgary (CA); Mogens F. Smed, DeWinton (CA)

(73) Assignee: DIRTT Environmental Solutions, LTD., Calgary (CA)

( * ) Notice: Subject to any disclaimer, the term of this patent is extended or adjusted under 35 U.S.C. 154(b) by 0 days.

(21) Appl. No.: 14/888,080

(22) PCT Filed: Aug. 27, 2014

(86) PCT No.: PCT/US2014/052819

§ 371 (c)(1),
(2) Date: Oct. 29, 2015

(87) PCT Pub. No.: WO2015/034715

PCT Pub. Date: Mar. 12, 2015

(65) Prior Publication Data

US 2016/0166086 A1 Jun. 16, 2016

Related U.S. Application Data

(60) Provisional application No. 61/875,394, filed on Sep. 9, 2013.

(51) Int. Cl.

| | |
|---|---|
| ***A47F 5/00*** | (2006.01) |
| ***A47F 5/08*** | (2006.01) |
| ***E04B 2/74*** | (2006.01) |
| ***E04B 2/72*** | (2006.01) |
| *A47B 96/02* | (2006.01) |

(52) U.S. Cl.

CPC ..... *A47F 5/0853* (2013.01); *A47F 5/0043* (2013.01); *E04B 2/72* (2013.01); *E04B 2/7448* (2013.01); *A47B 96/028* (2013.01); *E04B 2002/7483* (2013.01)

(58) Field of Classification Search

CPC ..... A47F 5/0853; A47F 5/0043; E04B 2/72; E04B 2/7448; E04B 2002/7485; A47B 96/028

USPC ..... 52/36.4, 36.5, 238.1, 239, 481.1, 481.2; 108/50.1, 50.2, 152, 137, 143; 160/351; 211/184

See application file for complete search history.

(56) References Cited

U.S. PATENT DOCUMENTS 4,269,005 A * 5/1981 Timmons ..... E04B 2/7425 52/239
5,038,539 A * 8/1991 Kelley ..... A47B 21/06 211/190

(Continued)

FOREIGN PATENT DOCUMENTS

DE 202008002066 U1 * 4/2008 ..... A47B 96/067
FR 2578732 A1 * 9/1986 ..... A47F 5/0846
IT EP 726044 A1 * 8/1996

*Primary Examiner* — Babajide Demuren
(74) *Attorney, Agent, or Firm* — Workman Nydegger

(57) ABSTRACT

Apparatuses, systems, and methods for constructing and installing architectural walls include adjustable shelves and a clamping mechanism. The clamping mechanism may allow the architectural wall to selectively secure a panel or shelf disposed through a hole in the wall. The clamping mechanism may also be loosened to allow the panel or shelf to be adjusted, removed, or replaced as needed.

25 Claims, 8 Drawing Sheets

(56) References Cited

U.S. PATENT DOCUMENTS

| | | | | | |
|---|---|---|---|---|---|
| 5,241,796 | A * | 9/1993 | Hellwig | E04B 2/7425 | 211/162 |
| 5,309,686 | A * | 5/1994 | Underwood | A47B 83/001 | 160/135 |
| 5,377,466 | A * | 1/1995 | Insalaco | E04B 2/7437 | 160/135 |
| 5,406,760 | A * | 4/1995 | Edwards | E04B 2/7416 | 160/351 |
| 5,692,717 | A * | 12/1997 | Glaeser | A47B 96/065 | 108/152 |
| 6,076,317 | A * | 6/2000 | Hellwig | E04B 2/7425 | 52/220.7 |
| 6,553,731 | B2 * | 4/2003 | Hsueh | A47F 5/0846 | 52/239 |
| 6,807,784 | B2 * | 10/2004 | Hsueh | A47F 5/0846 | 211/87.01 |
| 6,928,785 | B2 * | 8/2005 | Shipman | A47B 57/425 | 52/239 |
| 2006/0207201 | A1 * | 9/2006 | Klimek | A47F 5/0846 | 52/239 |
| 2007/0278360 | A1 * | 12/2007 | Chen | A47B 57/54 | 248/121 |
| 2008/0202039 | A1 * | 8/2008 | Picchio | A47B 95/008 | 52/36.5 |
| 2013/0112637 | A1 * | 5/2013 | Kuhn | A47F 5/0853 | 211/105.1 |
| 2013/0220947 | A1 * | 8/2013 | Pintur | A47F 5/0018 | 211/1 |
| 2013/0308999 | A1 * | 11/2013 | Black | F16B 5/0614 | 403/205 |
| 2014/0091051 | A1 * | 4/2014 | Battilana | G09F 7/08 | 211/119.003 |

* cited by examiner

PASS THROUGH SHELF WALL ASSEMBLY

CROSS-REFERENCE TO RELATED APPLICATIONS

The present invention is a 35 U.S.C. §371 U.S. National Stage of PCT Application No. PCT/US2014/052819, filed Aug. 27, 2014, claims the benefit of priority to U.S. Provisional Application No. 61/875,394, filed Sep. 9, 2013. The entire content of each of the foregoing patent applications is incorporated herein by reference.

BACKGROUND OF THE INVENTION

1. The Field of the Invention

This invention relates to architectural walls. More specifically, the present disclosure relates to architectural walls that include adjustable shelves attached thereto.

2. Background and Relevant Art

Architects and interior designers often use walls to separate space within an indoor environment, such as a home, an office, or another building. While some walls are structural and load-bearing, other walls are architectural and function to provide organization, direct traffic flow, or increase functionality of the interior environment. Architectural walls allow the architect or interior designer to freely adapt the interior environment to particular or changing needs. Architectural walls may be used in conjunction with raised floors or drop ceilings in order to better enable electrical, HVAC, plumbing or telecommunication systems to be installed and maintained. Architects and interior designers may use architectural walls to provide adaptable organization and display options, as well.

With traditional fixed walls, installation of shelves requires drilling into the material of the wall and requires that fasteners, such as screws, nails, or bolts, be inserted to affix the shelves to the wall. When doing this, the location of the shelves must be properly measured and the shelves themselves leveled before installation. Once installed, the shelves will be immovably affixed in that position. One must remove the fasteners and create new holes in the material of the wall in order to alter the position of the shelves. This will also leave unsightly and damaging holes in the material of the wall, requiring more resources to either repair or hide and may compromise the strength of the wall.

Architectural walls provide an alternative to damaging traditional fixed walls. Architectural walls may be made of one or more of various woods, pressboard, plywood, glass, sheetrock, plastic, metals, textiles, or similar materials. Furthermore, architectural walls may be modular, allowing for interchangeable components being made of different materials. However, while architectural walls may provide an array of additional options due to modularity and lightweight construction, these same characteristics may make architectural walls weaker and reduce an architectural wall's ability to support shelves or objects hung upon them.

Thus, there are a number of problems with architectural walls that can be addressed.

BRIEF SUMMARY OF THE INVENTION

Implementations of the present disclosure solve one or more of the foregoing or other problems in the art with apparatuses, systems, and methods for constructing and installing architectural walls that include adjustable shelves. A shelf clamping mechanism may allow an architectural wall to adjustably support one or more shelves without damage to the shelves or the wall. The shelf clamping mechanism may reside inside the architectural wall or on a back side of the architectural wall opposite an outwardly visible or public front side of the architectural wall. Additionally, the shelf clamping mechanism may allow selection of a depth and an angle of the shelf relative to the wall. With the shelf clamping mechanism affixed to the architectural wall, the shelf passes through a pass-through slot in the wall to provide a shelf surface on the front of the wall while being held in place by the clamping mechanism (e.g., either inside or on the back side of the architectural wall). The clamping mechanism may be slidably repositionable on the wall in line with the pass-through slot enabling additional support when and where needed. The clamping mechanism may, additionally, attach to support members in the architectural wall, transferring the load supported by the shelf clamping system to a more robust structure than the material of the wall itself.

Additional features and advantages of exemplary implementations of the disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the disclosure and are not therefore to be considered to be limiting of its scope, the embodiments will be described and explained with additional specificity and detail through the use of the accompanying drawings in which.

DETAILED DESCRIPTION OF THE PREFERRED EMBODIMENTS

One or more implementations of the present disclosure relate to constructing and installing architectural walls configured to support adjustable shelves. The architectural walls may include a clamping mechanism that is configured to support shelves and objects placed thereupon. The clamping mechanism may also secure the shelves at variable positions, allowing the depth or position of the shelves to be reconfigured or allowing the shelves to be hidden altogether as needed, in addition to allowing interchangeability of shelves.

Figure 1:
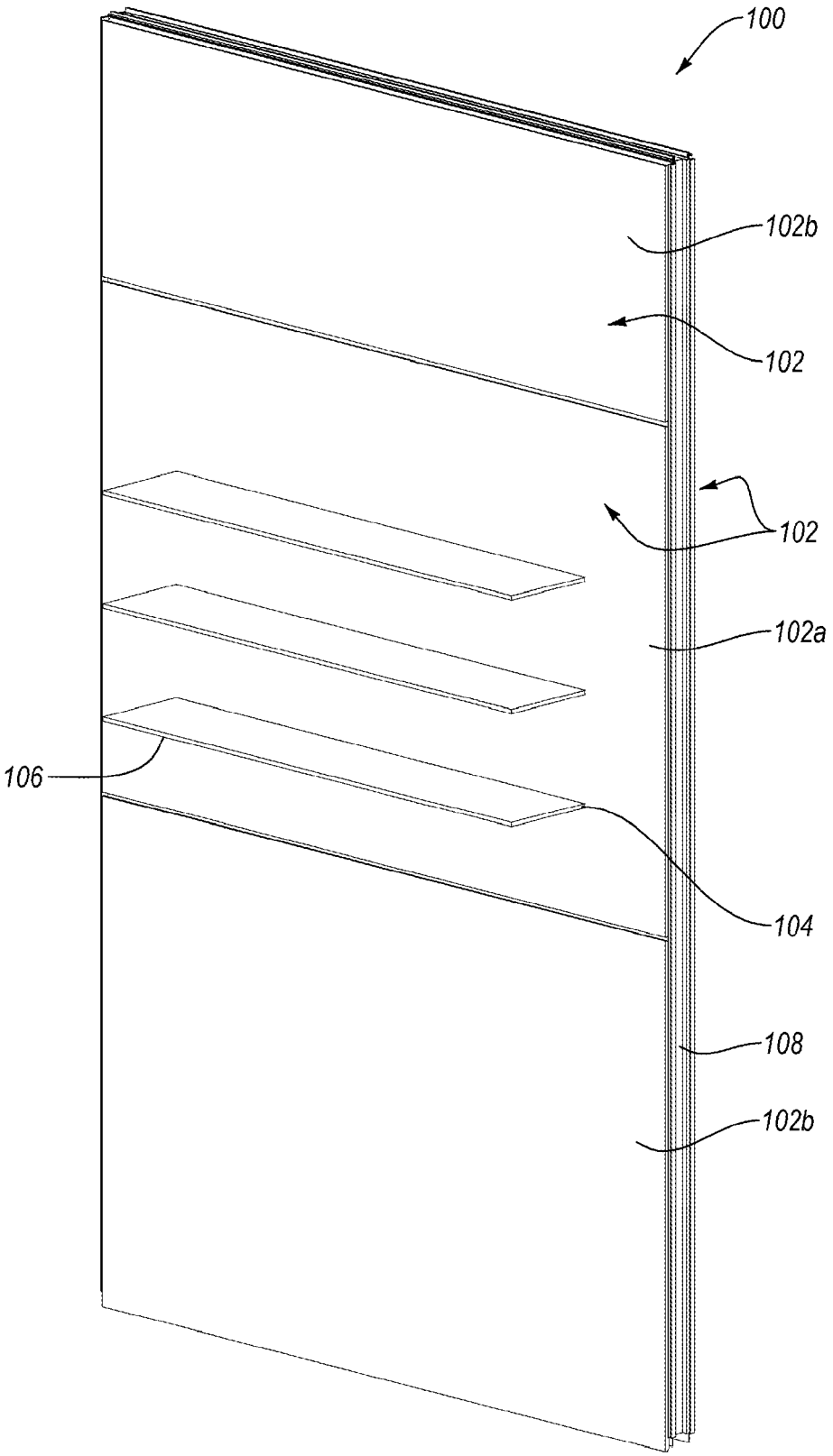
FIG. 1 is a perspective view of the front of an architectural wall system in accordance with an embodiment described herein.

FIG. 1 is a perspective view of the front of an architectural wall 100. In an exemplary embodiment, the architectural wall 100 may include one or more panels 102 (e.g., 102*a*, 102*b*) and a frame 108. The frame 108 may provide structure rigidity to the architectural wall 100. The one or more panels 102 may be selectively or permanently attached to the frame 108 to at least partially enclose the interior of the architectural wall 100 and to provide a desired aesthetic to the architectural wall 100. The one or more panels 102 may be made of woods, pressboard, plywood, glass, sheetrock, plastic, metals, textiles or similar materials.

The one or more panels 102 may include one or more slotted panels 102*a* and/or one or more solid panels 102*b*. Each of the panels 102 may include an interior surface that faces the interior of the architectural wall 100 and a visible exterior surface. Each of the slotted panels 102*a* may include one or more slots 104 through which one or more shelves 106 may fit. In an exemplary embodiment, the slots 104 are sized to approximately match the dimensions of the shelves 106, thereby producing a nearly gapless appearance in the front view of the architectural wall 100. The shelves 106 may be made of woods, pressboard, plywood, glass, sheetrock, plastic, metals, textiles, or similar materials.

Figure 2:
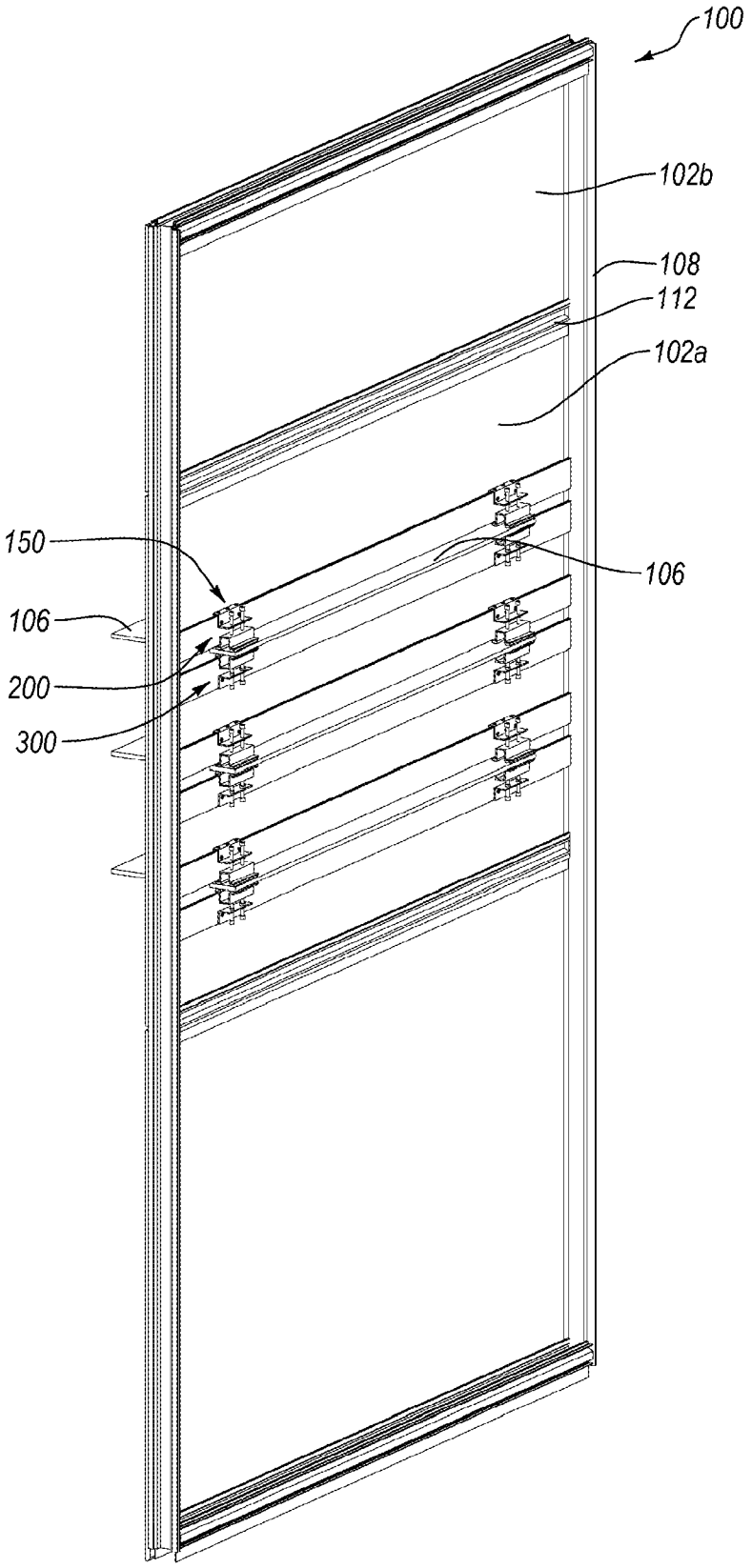
FIG. 2 is a perspective view of the back of an architectural wall system in accordance with an embodiment described herein.

FIG. 2 is a perspective view of the back of the architectural wall 100 with a back panel 102 removed to expose the interior of the architectural wall 100. In addition to the components shown in FIG. 1, the architectural wall 100 may include a section frame 112. The section frame 112 may provide additional rigidity to the frame 108 while also supporting slotted panel 102*a* or optional solid panel 102*b*. The architectural wall 100 may also include one or more clamping mechanisms (e.g., clamping mechanism 150).

The clamping mechanisms may include a first clamp 200 and a second clamp 300. The first clamp 200 may be an upper clamp configured to apply a force to the shelf 106 and the second clamp 300 may be a lower clamp configured to apply an opposing force to the shelf 106. In an exemplary embodiment, the first clamp 200 may substantially oppose the second clamp 300 when in contact with the shelf 106 and when the shelf 106 is disposed between the first clamp 200 and the second clamp 300. That is, the first and second clamps 200, 300 may be disposed on and apply their respective forces to opposing sides of the shelf 106.

Figure 3:
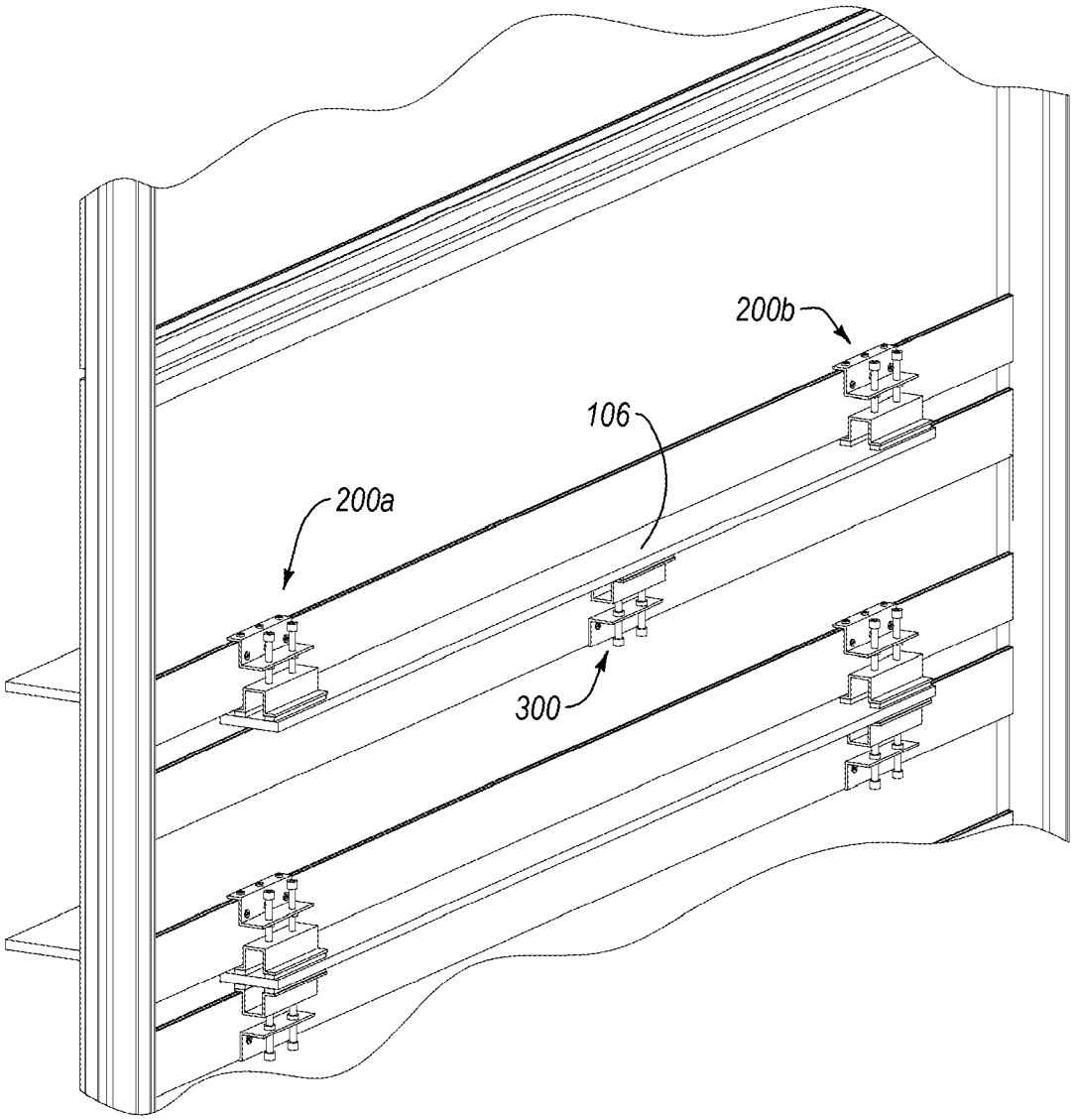
FIG. 3 is a perspective view of the back of an architectural wall system depicting non-aligned sets of upper and lower clamps in an embodiment

The number and relative positioning of the first and second clamps 200, 300 may vary from one implementation to another. For instance, FIG. 3 illustrates an embodiment with two first clamps 200*a*, 200*b* and only one second clamp 300. As illustrated in FIG. 3, the second clamp 300 may be laterally disposed between the two first clamps 200*a*, 200*b*. In other words, the second clamp 300 may be offset from or non-aligned with one or both of the first clamps 200*a*, 200*b*. As a result, the forces applied to the shelf 106 by both of the two first clamps 200*a*, 200*b* may balance with the force applied to the shelf 106 by the second clamp 300. Irrespective of the number of first and second clamps in a particular embodiment, the net force applied to the shelf by first clamps may be substantially balanced by the net force applied to the shelf by the second clamps.

Figure 4:
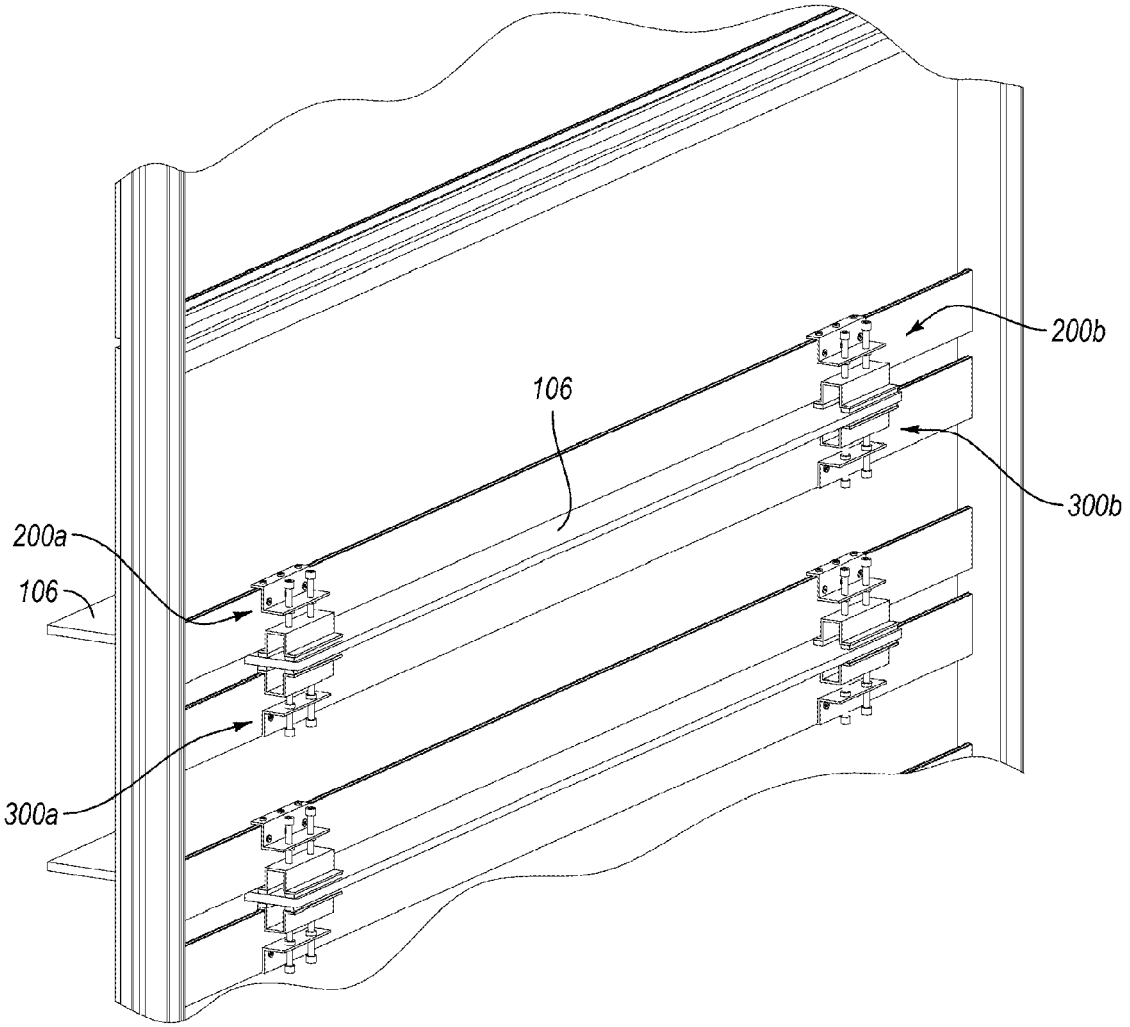
FIG. 4 is a perspective view of the back of an architectural wall system depicting aligned sets of upper and lower clamps in an embodiment.

FIG. 4 illustrates an embodiment with aligned first and second clamps. More specifically, a first clamp 200*a* and a second clamp 300*a* are generally aligned with one another on opposing sides of the shelf 106 such that the first clamp 200*a* is positioned vertically above the second clamp 300*a*. Similarly, a first clamp 200*b* and a second clamp 300*b* are generally aligned with one another on opposing sides of the shelf 106 such that the first clamp 200*b* is positioned vertically above the second clamp 300*b*. The opposing forces provided by the first clamps 200*a*, 300*a* and the second clamps 200*b*, 300*b*, respectively, balance one another to keep the shelf 106 stationary.

Figure 5:
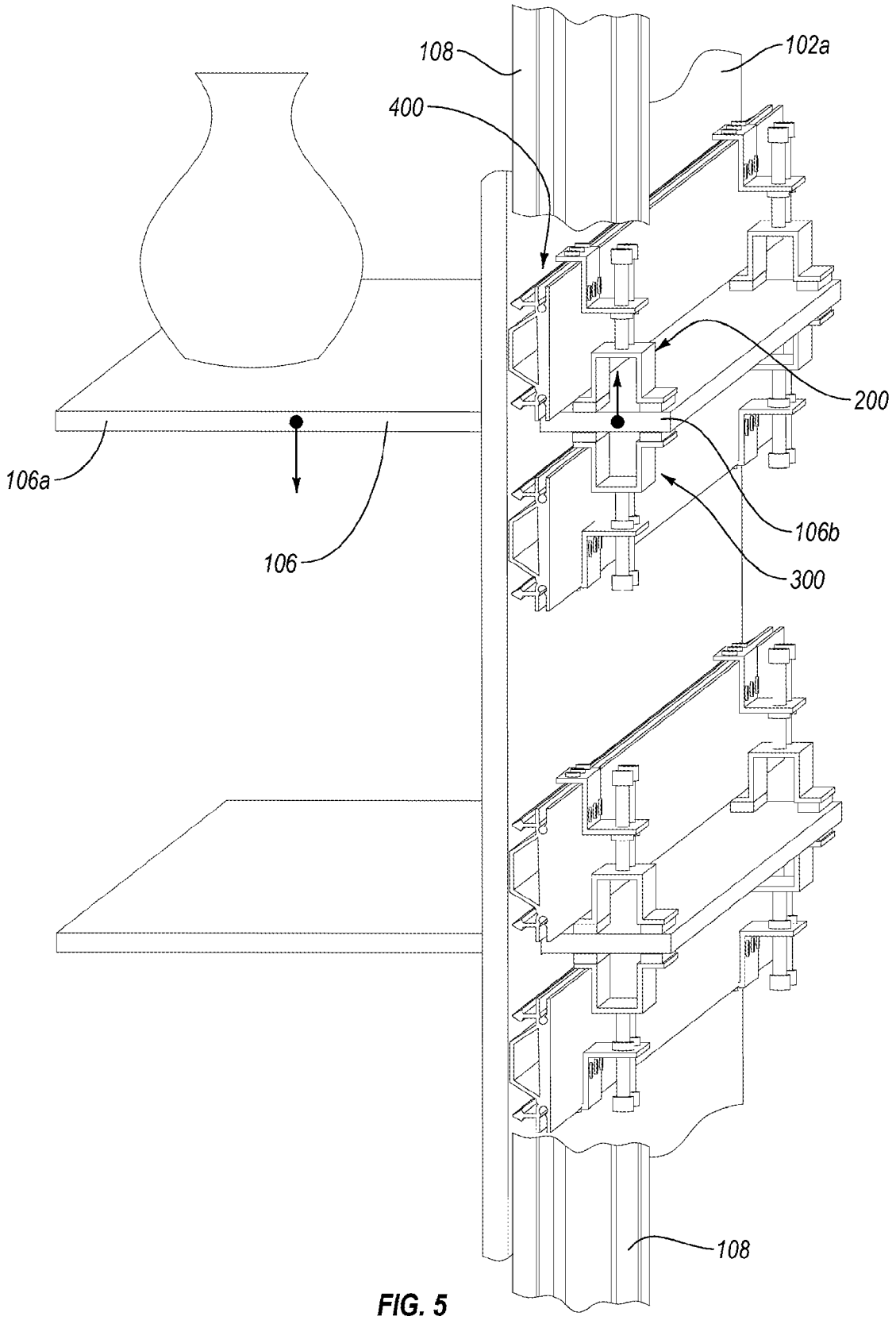
FIG. 5 is a side perspective view of an architectural wall system in use.

As shown in FIG. 5, when an object is placed upon a front end 106*a* of the shelf 106, the shelf 106 acts as a lever and applies a force upward against the first clamp(s) 200 via a back end 106*b* of the shelf 106.

As can be seen in FIG. 5, the first clamp(s) 200 may be connected to an upper support member 400. The upper support member 400 transmits the force from the upper clamp(s) 200 to the frame 108. The upper support member 400 may add structural rigidity to the architectural wall 100 by distributing forces and allowing the frame 108 to bear the force due to objects on the shelves 106.

Figure 6:
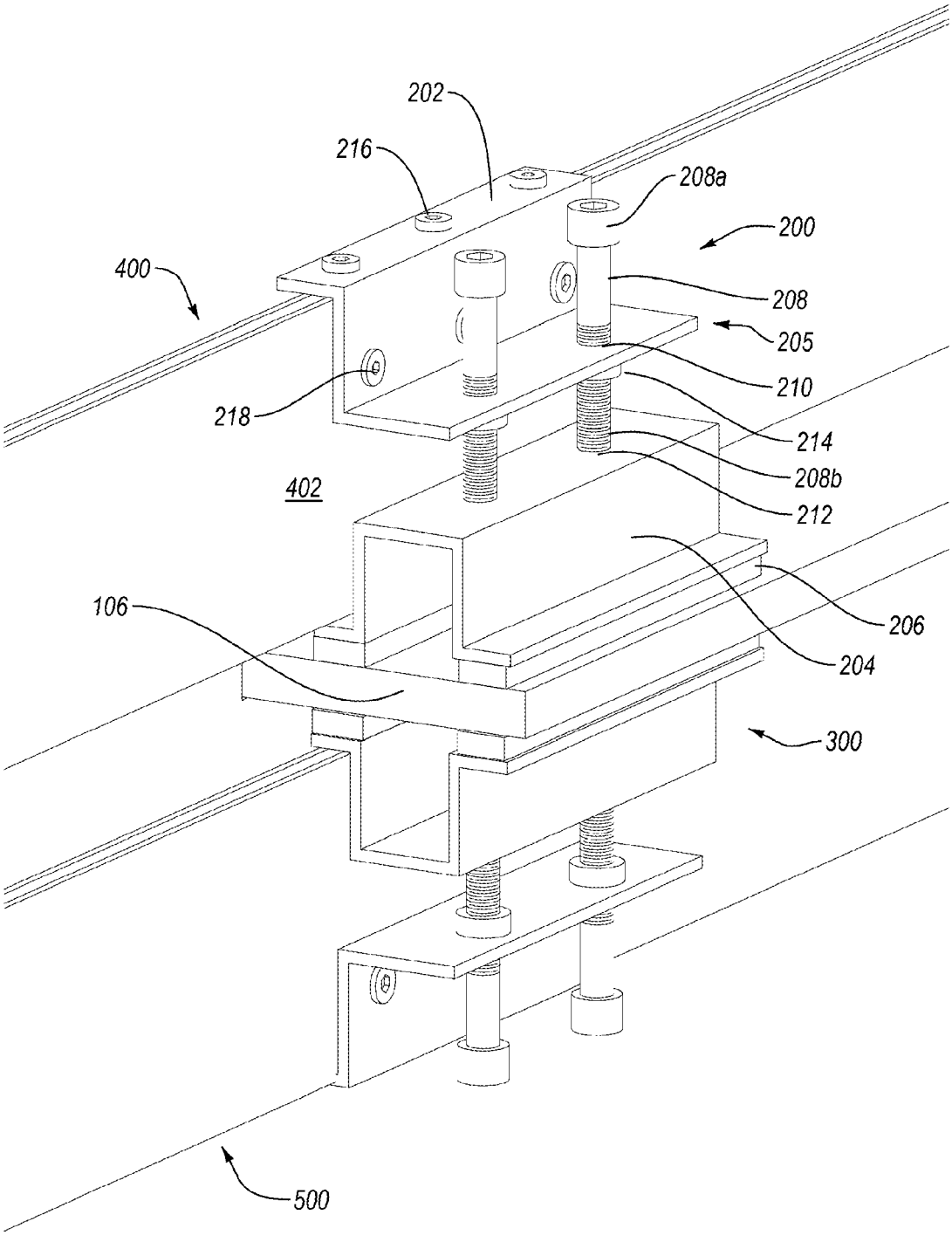
FIG. 6 is a perspective view of a clamping mechanism in accordance with an embodiment described herein.
Figure 7:
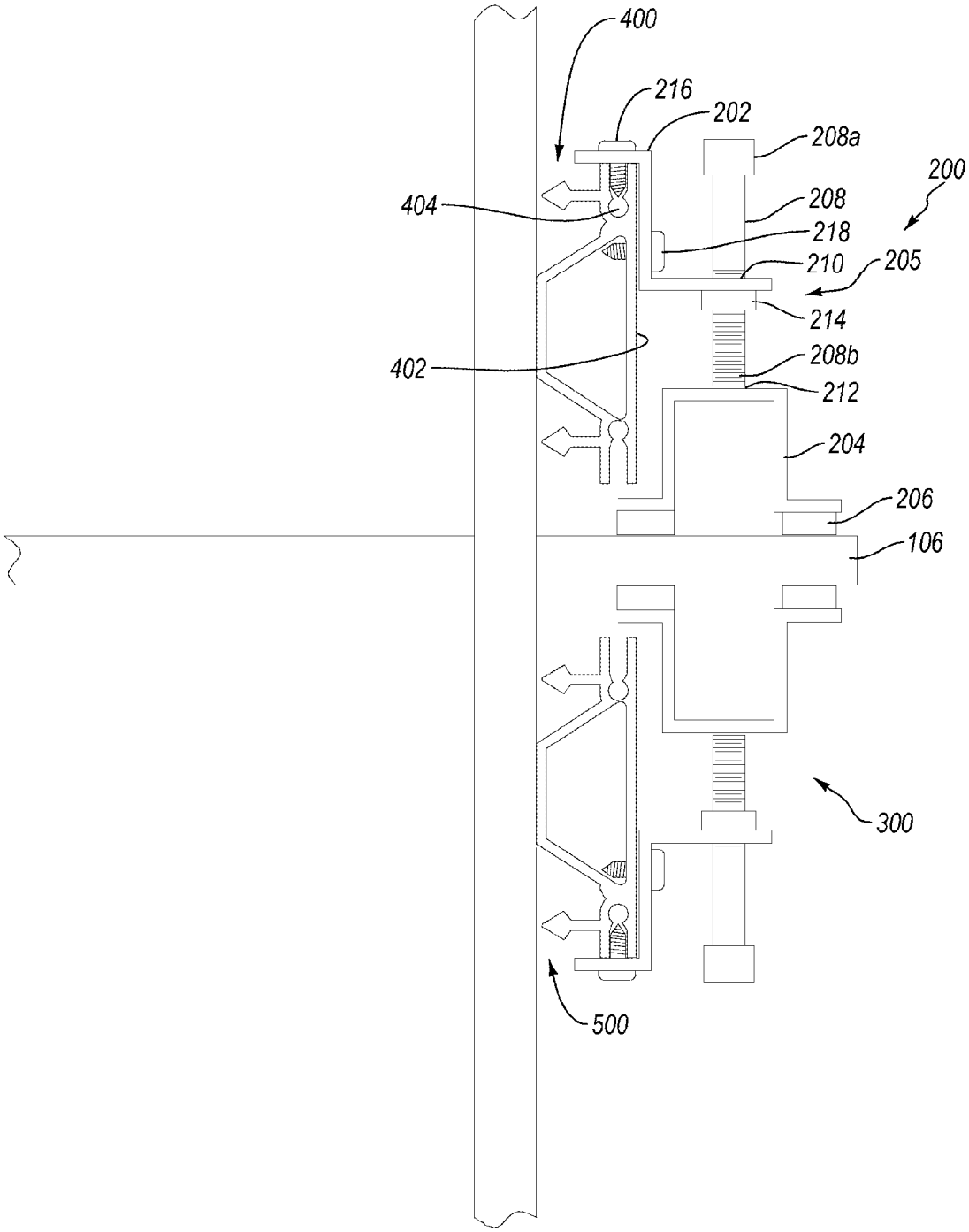
FIG. 7 is a side view of a clamping mechanism in accordance with an embodiment described herein.

FIGS. 6 and 7 illustrate detail views of the first clamp 200 and the second clamp 300 and the connection thereof to shelf 106. In the illustrated embodiment, and as will be discussed in greater detail below, both the first clamp 200 and the second clamp 300 are adjustable relative to the shelf 106. That is, both the first clamp 200 and the second clamp 300 can be adjusted to facilitate insertion and securement of the shelf 106 therebetween. In another embodiment, the first clamp 200 may be fixed relative to shelf 106 while the second clamp 300 is adjustable relative to the shelf 106. In yet another embodiment, the second clamp 300 may be fixed relative to the shelf 106 while the first clamp 200 is adjustable relative to the shelf 106.

As illustrated in FIGS. 6 and 7, the first clamp 200 and second clamp 300 may be identical to one another, but inverted. For simplicity, only the first clamp 200 and the upper support member 400 will be described. However, one will appreciate that the description of the first clamp 200 and the upper support member 400 may apply equally to the second clamp 300 and lower support member 500.

The first clamp 200 may include a fixed bracket 202, a moving bracket 204, one or more pads 206, and a displacement mechanism 205 that connects fixed bracket 202 and moving bracket 204 and allows for relative movement therebetween. The displacement mechanism 205 may comprise at least one threaded stud 208 having a proximal end 208*a* and a distal end 208*b*. The proximal end 208*a* may be configured to receive a screwdriver or wrench. Alternatively or additionally, the proximal end 208*a* may be configured (e.g., via grooves or wings) to facilitate rotation of the threaded stud 208 without the need of tools.

Threaded stud 208 may be configured to pass through a complimentarily threaded hole 210 in fixed bracket 202 and engage moving bracket 204. Moving bracket 204 may have, on a side proximate fixed bracket 202, a depression 212 adapted to receive distal end 208*b* of threaded stud 208 to facilitate alignment between brackets 202, 204. As the threaded stud 208 is advanced distally through hole 210, the threaded stud 208 applies a force to depression 212, and hence to moving bracket 204. The force that the threaded stud 208 applies to moving bracket 204 may cause moving bracket 204 to move toward shelf 106 to secure shelf 106 between the first and second clamps 200, 300.

Upper clamp 200 may optionally include a threaded nut 214. Threaded nut 214 may be complimentarily threaded to threaded stud 208 and be positioned on threaded stud 208 adjacent to fixed bracket 202. Threaded nut 214 may limit or prevent unintentional movement of threaded stud 208 relative to fixed bracket.

As illustrated in FIGS. 6 and 7, the upper clamp 200 is connected to upper support member 400. Upper support member 400 may comprise an upper support member face 402 and an upper support member channel 404. Fixed bracket 202 may be connected to upper support member channel 404 by one or more screws 216 or similar suitable fasteners. The screws 216 may secure fixed bracket 202 to upper support member 400. In some embodiments, screws 216 secure fixed bracket 202 to upper support member 400 in a manner that limits or prevents vertical movement of fixed bracket 202 relative to upper support member 400. Furthermore, in some embodiments, screws 216 secure fixed bracket 202 to upper support member 400 in a manner that allows fixed bracket 202 to move relative to upper support member 400 along the length of upper support member 400.

In addition or as an alternative to screws 216, fixed bracket 202 may be secured to upper support member 400 by one or more screws 218. The one or more screws 218 may contact upper support member face 402 and, when tightened against upper support member face 402, retard or prevent movement of the fixed bracket 202. In another embodiment, one or more fixed bracket face screws 218 may penetrate upper support member face 402 to provide greater retention of fixed bracket 202.

In an embodiment, upper clamp 200 may be slidably repositioned along the length of upper support member 400. This can be accomplished by loosening screws 218 from upper support member face 402 and optionally loosening screws 216 from within upper support member channel 404. Upper clamp 200 may then slide along upper support member 400. Once repositioned in a desired location, upper clamp 200 may be secured in place by tightening screws 216 into upper support member channel 404 and/or by tightening screws 218 against/into upper support member face 402.

As noted above, second clamp 300 may be similar or identical to first clamp 200 except for being inverted. Accordingly, second clamp 300 may include a fixed bracket, a movable bracket, and a displacement mechanism. As with displacement mechanism 205, the displacement mechanism of the second clamp 300 may enable movement of the movable bracket relative to the fixed bracket in order to secure the shelf 106 between the first clamp 200 and the second clamp 300.

As also noted above, at least one of the first and second clamps may be non-adjustable. For instance, a non-adjustable clamp may not include a displacement mechanism that allows for relative movement between a fixed bracket and a movable bracket. Rather, a non-adjustable bracket may include a fixed bracket (that is similar or identical to fixed bracket 202) and a second bracket (that is similar or identical to movable bracket 204) that are connected together or integrally formed so as to limit or prevent relative movement therebetween. In embodiments that include a non-adjustable clamp, an adjustable clamp (e.g., clamp 200) may be adjusted to secure a shelf 106 between the non-adjustable and adjustable clamps.

Figure 8A:
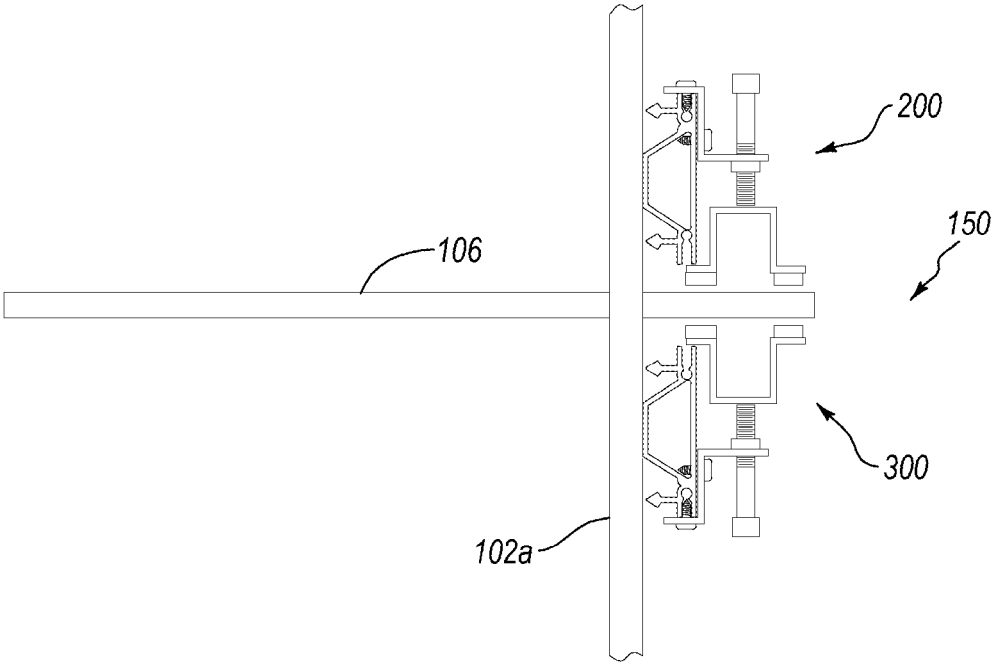
FIG. 8*a* is a perspective view illustrating adjustment of a clamping mechanism.
Figure 8B:
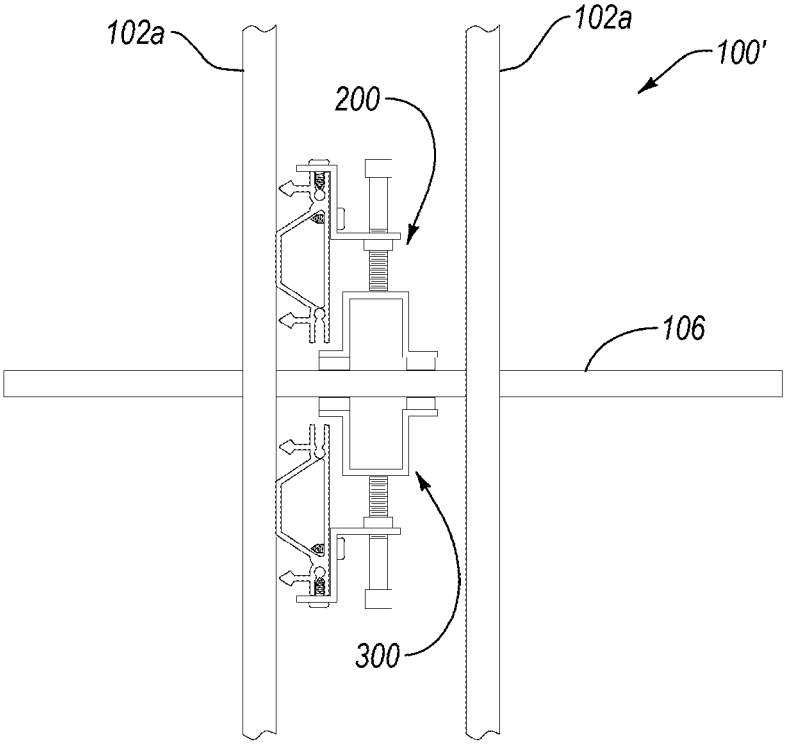
FIG. 8*b* is a perspective view illustrating an architectural wall system with a shelf extending out of both sides thereof.

FIGS. 8*a* and 8*b* illustrate examples of how clamping mechanism 150 facilitates adjustment and securement of shelf 106 therebetween. For instance, FIG. 8*a* illustrates first and second clamps 200, 300 in non-engaged positions (e.g., movable brackets are retracted away from shelf 106). With one or both of clamps 200, 300 in the non-engaged positions, shelf 106 may be inserted or removed from between clamps 200, 300 as desired. Thereafter, first clamp 200 and/or second clamp 300 may be adjusted to the engaged position (e.g., movable brackets are extended towards shelf 106) to secure shelf 106 in a desired position.

FIG. 8*b* illustrates an architectural wall 100', the elements, components, and configuration of which may be similar or identical to those of architectural wall 100. For instance, architectural wall 100' may include opposing front and back panels 102 (e.g., slotted panels 102*a*), a frame (not shown), a shelf 106, and opposing first and second clamps 200, 300 that selectively secure the shelf 106 in place.

As discussed herein, the first and second clamps 200, 300 enable shelf 106 to be selectively secured to architectural wall 100'. Additionally, first and second clamps 200, 300 enable the position of shelf 106 to be adjusted. By way of example, the architectural wall 100' illustrated in FIG. 8*b* includes a shelf 106 that extends out of both a front side and a back side of architectural wall 100', thereby creating a shelf surface on both sides of architectural wall 100'. To facilitate the extension of shelf 106 out of both sides of architectural wall 100', architectural wall 100' includes, as noted above, slotted panels 102*a* on both the front side and back side thereof. Accordingly, shelf 106 may extend through a slot 104 in the slotted panel 102*a* on the front side of architectural wall 100' as well as through a slot 104 in the slotted panel 102*a* on the back side of architectural wall 100'. The first and/or second clamps 200, 300 may be loosened to enable shelf 106 to be selectively moved forward or backward so that more of the shelf 106 extends out of either the front side or the back side of the architectural wall 100'. Once the shelf 106 is positioned as desired, the first and/or second clamps 200, 300 may be adjusted to secure the shelf 106 in place.

Implementations of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

We claim:

1. An architectural wall system comprising:

a frame comprising two vertical support members and first and second horizontal support members connected between the two vertical support members;

one or more panels connectable to the frame, the one or more panels comprising at least one slotted panel disposed on a front side of the architectural wall system, the at least one slotted panel having a slot formed therethrough, the slot being disposed between the first and second horizontal support members, the frame and the one or more panels cooperating to at least partially define an interior space within the architectural wall;

a first clamp connectable to the first horizontal support member and a second clamp connectable to the second horizontal support member, and the first clamp and the second clamp being configured to be disposed within the interior space of the architectural wall, the first clamp and the second clamp substantially opposing one another, at least one of the first clamp and the second clamp being selectively adjustable relative to the other, at least one of the first clamp or the second clamp being selectively adjustable along a length of the corresponding horizontal support member such that the at least one of the first clamp or the second clamp can be selectively repositioned between the two vertical support members; and a shelf selectively positionable between the first clamp and the second clamp, wherein the first clamp and the second clamp are configured to secure the shelf therebetween, and wherein the shelf is configured to extend through the slot in the at least one slotted panel.

2. The architectural wall system of claim 1, wherein the first clamp comprises a fixed bracket and a moving bracket disposed on a first side of the shelf.

3. The architectural wall system of claim 2, wherein the moving bracket is selectively movable relative to the fixed bracket to selectively secure the shelf between the first clamp and the second clamp.

4. The architectural wall system of claim 2, wherein the first clamp comprises a displacement mechanism that connects the fixed bracket and the moving bracket, the displacement mechanism being configured to facilitate movement of the moving bracket relative to the fixed bracket.

5. The architectural wall system of claim 1, wherein each of the first clamp and the second clamp comprises a fixed bracket and a moving bracket.

6. The architectural wall system of claim 5, wherein the fixed bracket and the moving bracket of the first clamp are disposed on a first side of the shelf.

7. The architectural wall system of claim 6, wherein the fixed bracket and the moving bracket of the second clamp are disposed on a second side of the shelf.

8. The architectural wall system of claim 7, wherein each of the first clamp and the second clamp comprises a displacement mechanism connecting the fixed bracket and moving bracket, the displacement mechanism of each of the first clamp and the second clamp being configured to move the respective moving bracket relative to the respective fixed bracket.

9. The architectural wall system of claim 1, wherein the one or more panels further comprise at least a second slotted panel having a slot formed therethrough and being disposed on a back side of the architectural wall system.

10. The architectural wall system of claim 9, wherein the shelf is configured to extend through the slot in the at least one slotted panel and the slot in the at least a second slotted panel such that the shelf extends from both the front side and a back side of the architectural wall system.

11. An architectural wall system comprising:

a frame;

a slotted panel connectable to the frame, the slotted panel having a slot formed therethrough;

a shelf configured to extend through the slot in the slotted panel;

a clamping mechanism connected to the frame and spanning the slot, the clamping mechanism being configured to retain a portion of the shelf disposed within the clamping mechanism, the clamping mechanism comprising:

at least one upper clamp disposed on a first side of the shelf, the at least one upper clamp comprising a fixed bracket and a moving bracket; and at least one lower clamp disposed on a second side of the shelf, the at least one lower clamp comprising a fixed bracket and a moving bracket;

wherein:

the at least one upper clamp and the at least one lower clamp are selectively adjustable via the corresponding moving bracket thereof to enable selective securement or removal of the shelf from the clamping mechanism and selective adjustment of the angle of the shelf;

each of the at least one upper clamp and at least one lower clamp further comprises a displacement mechanism connecting the corresponding fixed bracket and the corresponding moving bracket thereof, the displacement mechanism being configured to move the moving bracket relative to the fixed bracket of the corresponding at least one upper or lower clamp; and movement of the moving brackets away from their respective fixed brackets secures a shelf between the at least one upper clamp and the at least one lower clamp.

12. The architectural wall system of claim 11, further comprising a support member connected to the frame.

13. The architectural wall system of claim 12, wherein at least one of the at least one upper clamp and at least one lower clamp is connected to the support member.

14. The architectural wall system of claim 11, wherein the clamping mechanism is slidably repositionable along at least a portion of the width of the architectural wall.

15. The architectural wall system of claim 11, wherein the shelf comprises glass.

16. The architectural wall system of claim 11, wherein at least one of the at least one upper clamp and at least one lower clamp is extendable without tools.

17. The architectural wall system of claim 12, wherein:

the support member comprises a horizontal support member connected between two vertical support members.

18. The architectural wall system of claim 11, wherein the displacement mechanism comprises a screw drive.

19. The architectural wall system of claim 11, wherein the moving bracket comprises padding configured to engage the shelf.

20. The architectural wall system of claim 11, wherein the displacement mechanism is operable without tools.

21. A clamping mechanism for securing a shelf to an architectural wall system, the clamping mechanism comprising:

one or more upper clamps disposed on a first side of the shelf, each of the one or more upper clamps comprising:

a fixed bracket;

a moving bracket; and a displacement mechanism connecting the fixed bracket and the moving bracket, the displacement mechanism being configured to move the moving bracket relative to the fixed bracket;

one or more lower clamps disposed on a second side of the shelf, each of the one or more lower clamps comprising:

a fixed bracket;

a moving bracket; and a displacement mechanism connecting the fixed bracket and the moving bracket, the displacement mechanism being configured to move the moving bracket relative to the fixed bracket, wherein:

each of the moving brackets is selectively adjustable to secure or release the shelf from between the upper and lower clamps and to adjust the angle of the shelf; and movement of the moving brackets away from their respective fixed brackets secures a shelf between the one or more upper clamps and the one or more lower clamps.

22. The clamping mechanism of claim 21, wherein movement of the moving brackets towards their respective fixed brackets releases a shelf between the one or more upper clamps and the one or more lower clamps.

23. The clamping mechanism of claim 21, wherein each of the moving brackets comprises padding that selectively engages a shelf positioned between the one or more upper clamps and the one or more lower clamps.

24. The clamping mechanism of claim 21, wherein each of the displacement mechanisms comprises a screw drive.

25. The clamping mechanism of claim 21, wherein each of the fixed brackets is selectively connectable to a frame of an architectural wall system.

* * * * *